US010711745B2

(12) United States Patent
Bessho et al.

(10) Patent No.: US 10,711,745 B2
(45) Date of Patent: Jul. 14, 2020

(54) WORK VEHICLE

(71) Applicant: Kubota Corporation, Osaka-shi (JP)

(72) Inventors: Hiroki Bessho, Sakai (JP); Kazuyuki Tashiro, Sakai (JP)

(73) Assignee: Kubota Corporation, Osaka (JP)

( * ) Notice: Subject to any disclaimer, the term of this patent is extended or adjusted under 35 U.S.C. 154(b) by 97 days.

(21) Appl. No.: 15/982,167

(22) Filed: May 17, 2018

(65) Prior Publication Data

US 2018/0347521 A1 Dec. 6, 2018

(30) Foreign Application Priority Data

Jun. 1, 2017 (JP) ..... 2017-109380
Feb. 26, 2018 (JP) ..... 2018-032397

(51) Int. Cl.

| | |
|---|---|
| ***F02M 35/10*** | (2006.01) |
| ***F01M 13/04*** | (2006.01) |
| ***F02M 35/12*** | (2006.01) |
| ***F02M 35/08*** | (2006.01) |
| ***F01M 11/00*** | (2006.01) |

(52) U.S. Cl.

CPC .. *F02M 35/10222* (2013.01); *F01M 11/0004* (2013.01); *F01M 13/04* (2013.01); *F02M 35/088* (2013.01); *F02M 35/10085* (2013.01); *F02M 35/1255* (2013.01); *F01M 2011/0008* (2013.01); *F01M 2011/0054* (2013.01); *F01M 2011/0062* (2013.01); *F01M 2013/0477* (2013.01)

(58) Field of Classification Search

CPC ..... F02M 35/10222; F02M 35/088; F02M 35/10085; F02M 35/1255; F02M 35/10144; F02M 35/10242; F02M 26/35; F01M 13/04; F01M 2013/0477

See application file for complete search history.

(56) References Cited

U.S. PATENT DOCUMENTS

| | | | | |
|---|---|---|---|---|
| 3,186,392 | A * | 6/1965 | Gregoric | F02M 27/08 123/568.15 |
| 9,732,707 | B1 * | 8/2017 | Urban | F02M 25/0854 |
| 2002/0073961 | A1 * | 6/2002 | Tanaka | F02M 35/10078 123/336 |
| 2008/0035128 | A1 * | 2/2008 | Richardson | F02M 35/10222 123/574 |
| 2009/0126709 | A1 * | 5/2009 | Manookian, Jr. | F02M 25/06 123/574 |

(Continued)

FOREIGN PATENT DOCUMENTS

| | | |
|---|---|---|
| JP | 2011185181 A | 9/2011 |
| JP | 201713690 A | 1/2017 |

*Primary Examiner* — Syed O Hasan
(74) *Attorney, Agent, or Firm* — The Webb Law Firm

(57) ABSTRACT

A work vehicle includes an engine, an intake passage through which combustion air flows from an ambient air inlet to an engine, an air cleaner for removing dust contained in the combustion air, a throttle valve for adjusting an intake amount of the combustion air by the engine, a blowby gas returning passage for returning blowby gas discharged from the engine to a mid portion of the intake passage, and an inclined passage portion that assumes a progressively downwardly inclined posture to be located at a lower position on downstream side in a flow direction, the inclined passage portion having a water draining portion at its lowermost end.

6 Claims, 9 Drawing Sheets

(56) References Cited

U.S. PATENT DOCUMENTS

2010/0269804 A1* 10/2010 Miyaji ..... F02M 35/10157
123/572
2015/0300222 A1* 10/2015 Khan ..... F01M 13/028
95/272

* cited by examiner

WORK VEHICLE

CROSS-REFERENCE TO RELATED APPLICATIONS

This application claims priority to Japanese Patent Application Nos. 2017-109380 and 2018-032397, filed Jun. 1, 2017 and Feb. 26, 2018, respectively, the disclosures of which are hereby incorporated in their entirety by reference.

BACKGROUND OF THE INVENTION

Field of the Invention

In e.g. a work vehicle disclosed in Japanese Unexamined Patent Application Publication No. 2017-13690, an intake passage for introducing air for engine combustion extends elongate from a vehicle body front portion to a vehicle body rear portion and, in midway of this intake passage and at a position near the rear side of the engine, an air cleaner is provided. Between this air cleaner and an air inlet opening of the engine, there is provided an intake passage disposed under an approximately horizontal posture, in the course of which a throttle valve is incorporated. Further, in a work vehicle disclosed in Japanese Unexamined Patent Application Publication No. 2011-185181, a blowby gas returning passage for returning blowby gas discharged from an engine to an intake passage is connected to a a position near a throttle valve in midway a passage extending from an air cleaner to the engine.

According to the conventional arrangements disclosed in the two patent documents identified above, since blowby gas discharged from the engine is returned to a position near the throttle valve, water contained in the blowby gas may adhere to the throttle valve. In a cold place, such water adhering to the throttle valve can be frozen, so there is a risk of an effective operation of the throttle valve becoming impossible.

Incidentally, as an arrangement for preventing such water freezing, it is conceivable to arrange such that engine cooling water is fed in circulation to the throttle valve for its heating. However, this arrangement requires unnecessary piping, thus making the arrangement complicated and inviting resultant cost increase.

Then, there is a need for making it possible to avoid such inconvenience of water adhesion to the throttle valve and its freezing thereon without inviting cost increase due to complexity of the arrangement.

Aside from the above, in the work vehicle disclosed in Japanese Unexamined Patent Application Publication No. 2011-185181, a PVC valve is mounted to a head cover attached to a cylinder head. This PCV valve is communicated to a downstream side intake passage of the throttle valve via a blowby gas passage.

If impurities such as oil, water, etc. contained in blowby gas stays in the intake passage, the intake passage can be blocked. Then, it is conceivable to provide an impurity collecting portion for collecting the impurities contained in blowby gas. However, even with provision of such impurity collecting portion, if this impurity collecting portion is hardly accessible from the outside of the vehicle body, inspection of the impurity collecting portion is troublesome. So, regular checking of the impurity collection portion will be conducted not frequently, so staying of the impurities may hinder smooth operation of the engine. Namely, the impurity collecting portion will become useless. For this reason, there is a need for a work vehicle having an impurity collecting portion which is provided therein in a useful manner.

SUMMARY OF THE INVENTION

A work vehicle according to the present invention comprises:

an engine;

an intake passage through which combustion air flows from an ambient air inlet to the engine;

an air cleaner for removing dust contained in the combustion air;

a throttle valve for adjusting an intake amount of the combustion air by the engine;

a blowby gas returning passage for returning blowby gas discharged from the engine to a mid portion of the intake passage; and an inclined passage portion that assumes a progressively downwardly inclined posture to be located at a lower position on downstream side in a flow direction, the inclined passage portion having a water draining portion at its lowermost end, the inclined passage portion being provided at a flow direction downstream portion at a returning passage connecting portion of the intake passage to which the blowby gas returning passage is connected;

wherein the blowby gas returning passage is connected to the intake passage on more downstream side in the flow direction than the air cleaner; and wherein the throttle valve is provided at a position that is on downstream side in flow direction of the inclined passage portion and that has an approximately same height or greater height as/than the returning passage connecting portion.

With the present invention, water contained in blowby gas which is returned to the intake passage via the blowby gas returning passage is guided to flow down to the lower side, namely, the downstream side in the flow direction in the inclined passage portion which is at a flow direction downstream portion at a returning passage connecting portion of the intake passage to which the blowby gas returning passage is connected. And, this water is drained to the outside of the intake passage via a water draining portion at its lowermost end. Also, as the inclined passage portion is provided between the blowby gas returning passage and the throttle valve, it is possible to separate the returning position of the blowby gas from the throttle valve by an amount corresponding to the presence of the inclined passage portion therebetween.

Therefore, by effectively preventing intrusion of water into the throttle valve, e.g. the inconvenience of adhesion and freezing of water into/on the throttle valve can be avoided, even in the case of use in a cold place.

Preferably, a resonator is provided on more downstream side in the flow direction than the lowermost end of the inclined passage portion.

With the above, with provision of the resonator, noise generated by air intake function can be suppressed. Such resonator is configured to silence sound by the resonance effect and its interior is formed hollow. As the resonator is provided on more downstream side in the flow direction than the lowermost end of the inclined passage portion, it becomes possible to temporarily store any water remaining undrained via the draining portion within the resonator, so intrusion of water into the throttle valve can be prevented.

A work vehicle according to the present invention comprises:

an engine supported to a vehicle body;

a blowby gas returning passage for returning blowby gas discharged from the engine to an intake passage of the engine; and an impurity collecting portion provided in an outer circumferential portion of the vehicle body for collecting impurity contained in the blowby gas.

With the above-described arrangement, since the impurity collecting portion is readily accessible from the outside of the vehicle body, checking of this impurity collecting portion is not troublesome, so that this impurity collecting portion can be checked regularly and properly.

In the above arrangement, preferably, the impurity collecting portion detachably includes a drain container in which collected impurity is stored.

With the above-described arrangement, since impurity can be removed from the drain container by detaching this drain container, collected impurity can be easily taken out.

In the above arrangement, preferably, the drain container is configured to allow transparent viewing of the impurity stored therein from the outside of the drain container.

With the above arrangement, it is possible to know storage of impurity without needing to detach the drain container. So, the drain container can be checked without trouble of detaching it.

In the above arrangement, preferably, the work vehicle further comprises:

a load carrying deck supported to a rear portion of the vehicle body, the load carrying deck being vertically pivotable between an elevated discharging posture wherein a front end portion of the deck is elevated relative to the vehicle body and a lowered loading posture wherein the front end portion of the deck is lowered relative to the vehicle body;

wherein the impurity collecting portion is provided in an outer circumferential portion of a rear portion of the vehicle body as the outer circumferential portion.

With the above arrangement, in the work vehicle having the load carrying deck which is pivotable to the elevated discharging posture wherein the front side of the deck is elevated relative to the vehicle body, there is formed an empty space at the rear portion of the vehicle body, so if the impurity collecting portion is provided in the outer circumferential portion at the rear portion of the vehicle body, such impurity collecting portion will be more readily accessible via the empty space. Taking this into consideration, the impurity collecting portion is provided in the outer circumferential portion in the rear portion of the vehicle body, so that the impurity collecting portion is made more readily accessible from the outside of the vehicle body and this impurity collecting portion can be checked even more easily.

DETAILED DESCRIPTION OF THE PREFERRED EMBODIMENTS

Next, a first embodiment as one of embodiments relating to an inventive work vehicle will be explained with reference to the accompanying drawings.

Incidentally, a front-rear direction and a left-right direction in the following discussion of this embodiment will be defined as follows, unless explicitly indicated otherwise. Namely, in FIGS. 1-9, a direction denoted with an arrow F is "vehicle body front side", a direction denoted with an arrow B is "vehicle body rear (back) side", a direction denoted with an arrow R is "vehicle body right side" and a direction denoted with an arrow L is "vehicle body left side", respectively.

[General Configuration]

Figure 1:
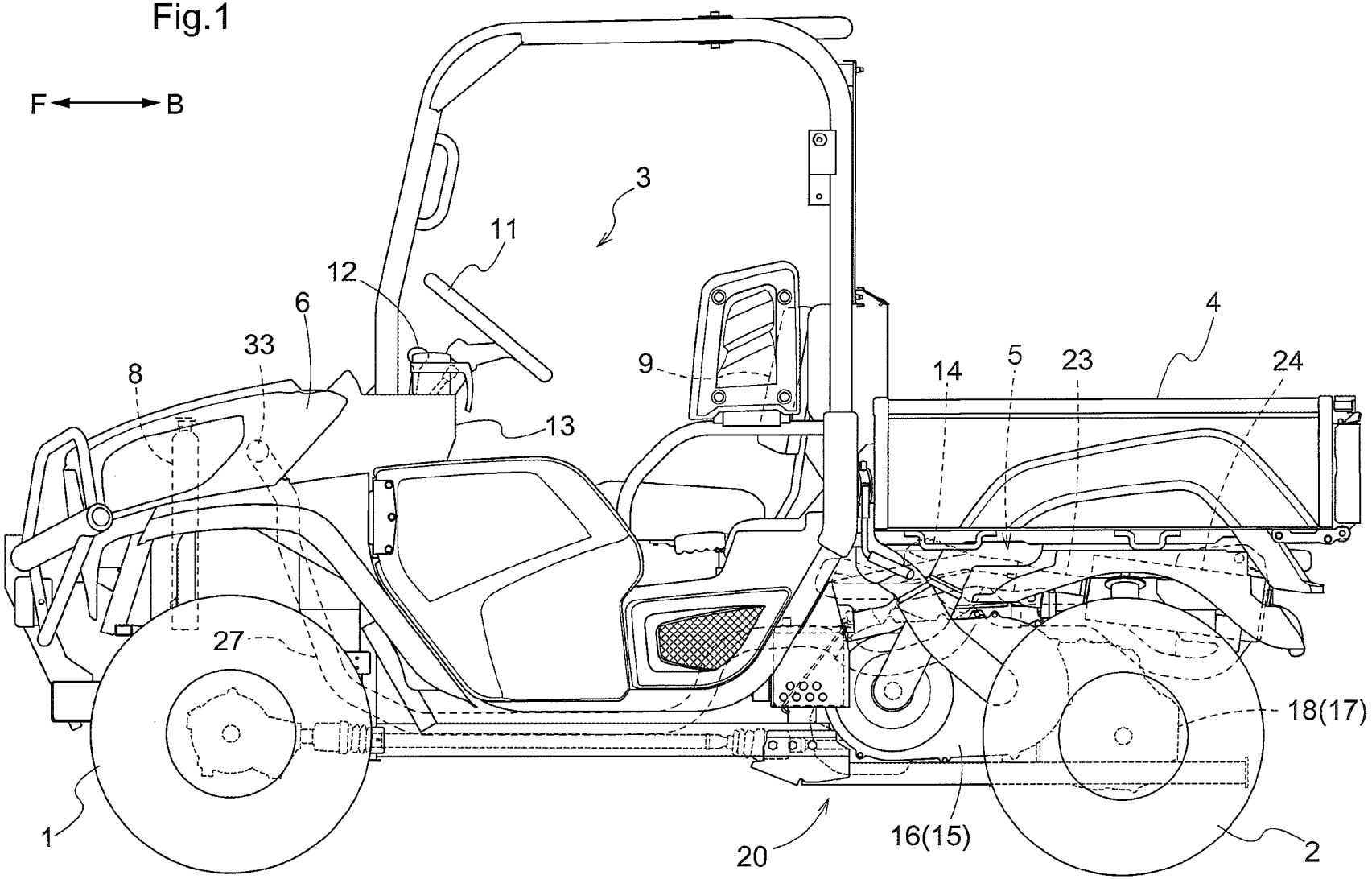
FIG. 1 is an overall side view of a utility vehicle according to a first embodiment.
Figure 2:
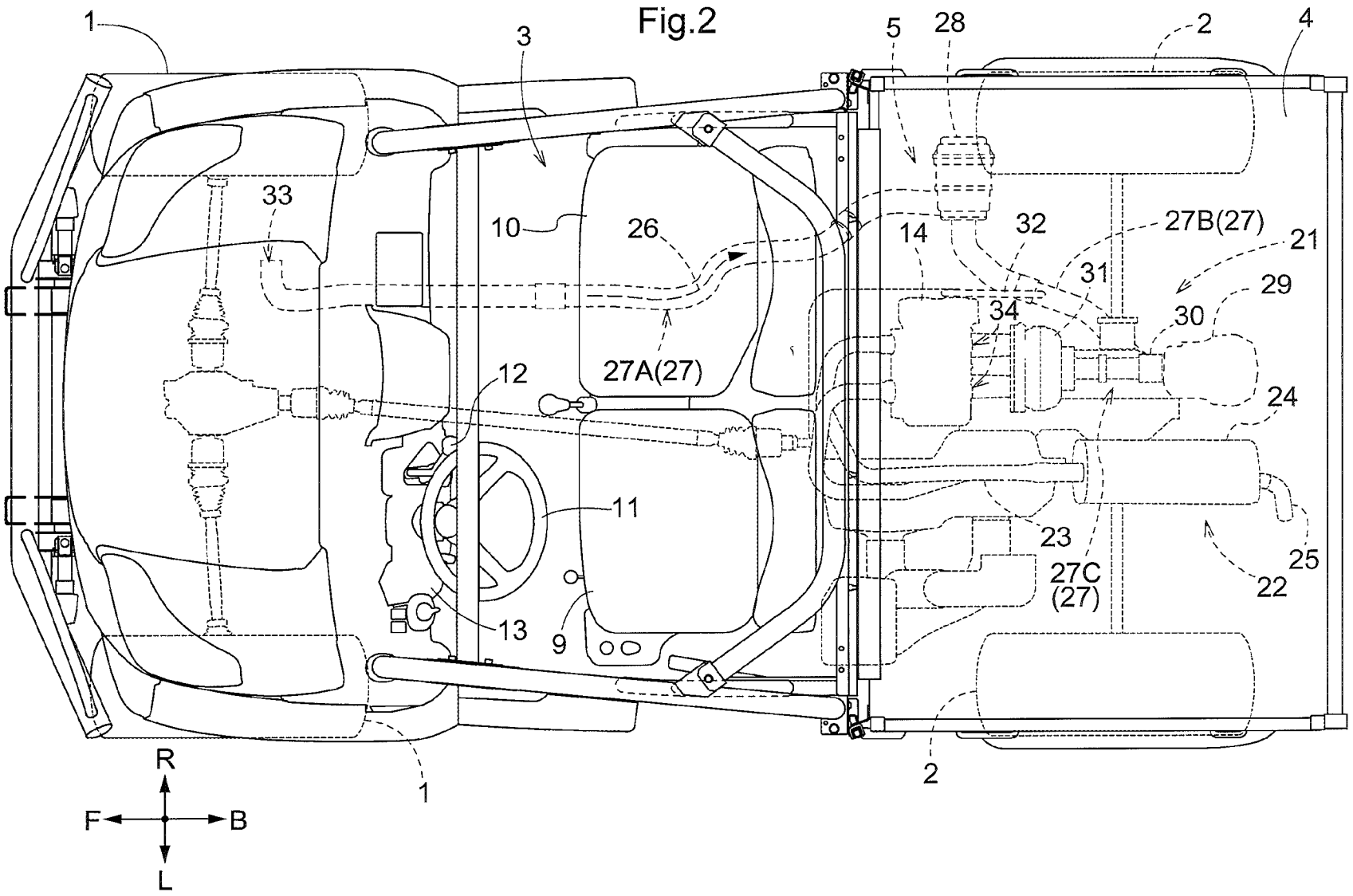
FIG. 2 is an overall plan view of the utility vehicle according to the first embodiment.

FIGS. 1 and 2 show a utility vehicle as an example of the work vehicle. This utility vehicle is a vehicle for multiple purposes such as load carrying, recreational activity, etc. The utility vehicle includes a pair of left and right front wheels 1 which can be steered and driven, and a pair of left and right rear wheels 2 which can be driven. At a front-rear center portion of the vehicle body, a driving section 3 is provided. Rearwardly of this driving section 3, a load carrying deck 4 is mounted. Downwardly of this load carrying deck 4, an engine section 5 is mounted. Forwardly of the driving section 3, an openable and closable front lid 6 is mounted. In a space inside the front lid 6, there are disposed an engine cooling radiator 8, etc.

In the driving section 3, there are provided a driver's seat 9 at which an operator will be seated, an auxiliary seat 10 at which a passenger can be seated, a steering wheel 11 for effecting a steering operation, a speed changer lever 12 for effecting a speed changing operation, and so on. The steering wheel 11 and the speed changer lever 12 are disposed in a driving panel 13 located forwardly of the driver's seat 9.

The load carrying deck 4 is configured to be switchable between a loading state capable of mounting load and a dumping state capable of discharging load. The load carrying deck 4, as being pivoted about a horizontal axis, can elevate its front end portion, thus being rendered into the dumping state in which load can be discharged (dumped) from the rear end side. Such state change (switching) of the load carrying deck 4 can be effected by e.g. driving of a hydraulic actuator.

As shown in FIG. 1, the engine section 5 includes a water-cooled gasoline engine (to be referred to as "engine 14" hereinafter), a speed changer case 16 accommodating a belt type stepless speed changer mechanism 15, a transmission case 18 accommodating a gear type speed changer mechanism 17, and so on.

Figure 4:
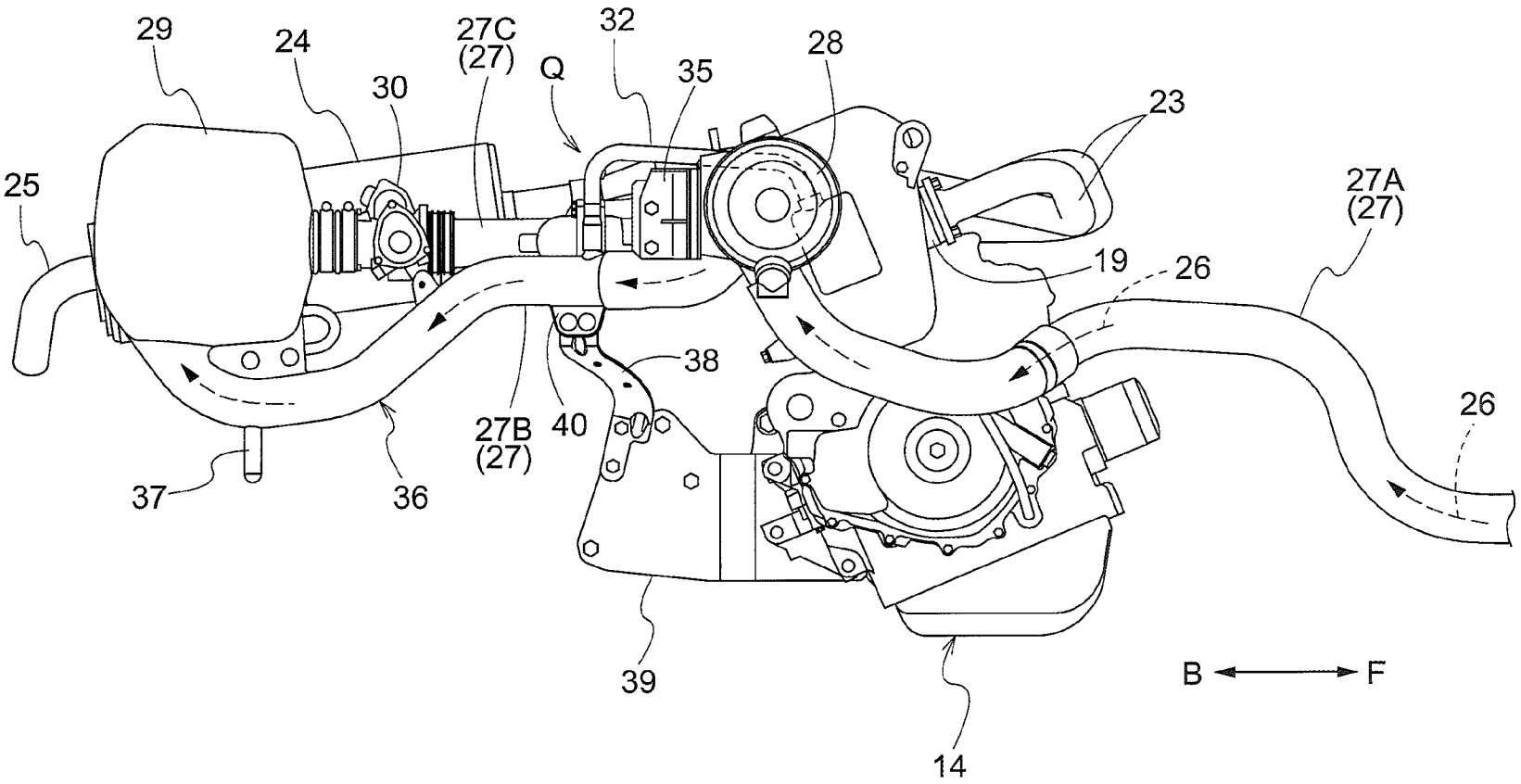
FIG. 4 is a side view of an air intake device in the first embodiment.

As shown in FIG. 4, the engine 14 is disposed in such a manner that a crank shaft is placed along a vehicle body left-right direction and a cylinder head 19 assumes an obliquely rearwardly inclined posture. The engine 14 is configured as a two-cylinder type. The speed changer case 16 is connected and supported to the lateral sides of the engine 14 and the transmission case 18. The transmission case 18 is connected and supported to a rear side of the engine 14.

The engine 14, the transmission case 18, etc. are supported to a vehicle body frame 20. This vehicle body frame 20, though not detailed, is configured as a frame structure consisting of a plurality of frame bodies extending in the front-rear direction and a plurality of frame bodies extending in the lateral direction.

The engine section 5 includes an intake device 21 for introducing ambient air into the engine 14, and an exhaust device 22 for discharging exhaust gas of the engine 14. As shown in FIG. 2, the intake device 21 and the exhaust device 22 are disposed in distribution on the left and right opposed sides.

The exhaust device 22 includes an exhaust pipe 23 through which exhaust gas discharged from the engine 14 flows and an exhaust muffler 24 capable of reducing exhaust noise. The exhaust pipe 23 firstly extends from the engine 14 to the vehicle body front side and then is bent to bypass the lateral side of the engine 14 to extend to the vehicle body rear side. The exhaust pipe 23 is disposed to pass above the speed changer case 16. Two such exhaust pipes 23 extend from the rear end portion of the engine 14 and then converge at the front end portion of the exhaust muffler 24 and then connected to the exhaust muffler 24. Exhaust gas whose exhaust noise has been reduced by the exhaust muffler 24 will be discharged to the outside from an exhaust opening 25 provided at a vehicle body rear portion.

[Intake Device]

Next, the intake device 21 will be explained.

Figure 3:
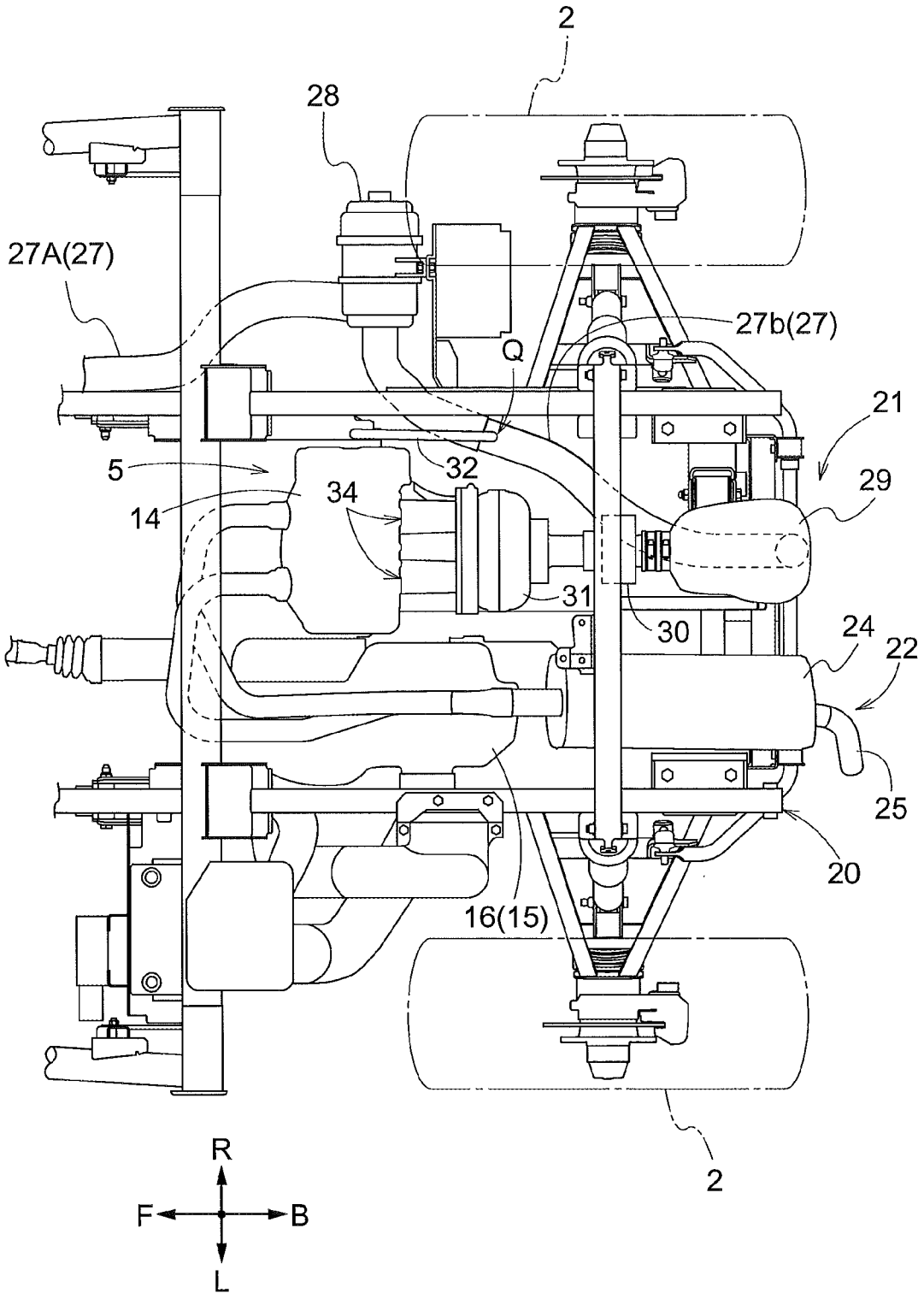
FIG. 3 is a plan view of an engine section in the first embodiment.

As shown in FIGS. 2-4, the intake device 21 includes an intake pipe 27 constituting an intake passage 26 through which combustion air to be introduced into the engine 14 flows, an air cleaner 28 for removing dust from the air, a resonator 29 for reducing noise of introduced air, a throttle valve 30 for adjusting a feed amount of combustion air to the engine 14, an intake branching portion 31 for branching the intake passage 26 to the respective cylinders of the engine 14, a blowby gas returning passage 32 for returning blowby gas discharged from the engine 14 to a mid portion of the intake passage 26 and so on.

As shown in FIG. 2, the intake pipe 27 extends long in the front-rear direction from the vehicle body front portion to the vehicle body rear portion. A vehicle body front side end portion of the intake pipe 27 is disposed in a space inside the front lid 6 and at this end portion, there is formed an ambient air inlet opening 33 for introducing ambient air from the outside. The intake pipe 27 includes a front side intake portion 27A that extends from the ambient air inlet opening 33 to the rear side and extends through the space inside the front lid 6 and under the driving section 3 to reach the air cleaner 28, an intermediate intake portion 27B that extends from the air cleaner 28 to the resonator 29 located at the vehicle body rear end, and an engine side intake portion 27C that extends from the resonator 29 to an intake opening 34 of the engine 14.

Inside the engine section 5, the air cleaner 28 is disposed on the right side at an upper portion of the engine 14, with a longitudinal direction of the air cleaner 28 being aligned with the vehicle body left-right direction. This air cleaner 28 is supported by a bracket 35. And, the bracket 35, though not detailed, is supported to the vehicle body frame 20.

As shown in FIG. 4, the intermediate intake portion 27B of the intake pipe 27 is provided with an inclined passage portion 36 that assumes a progressively downwardly inclined posture to be located at a lower position on downstream side in a flow direction. At the lowermost end of this inclined passage portion 36, there is provided a water draining portion 37 for discharging water present inside the intake pipe 27 to the outside. The lowermost end of the inclined passage portion 36 is connected to a downstream side portion of the resonator 29.

The engine side intake portion 27C of the intake pipe 27 is connected to an upstream side portion of the resonator 29. The engine side intake portion 27C incorporates a throttle valve 30 on the upstream side in the flow direction, and on the downstream side in the flow direction, the intake branching portion 31 is provided. The connecting portion to the resonator 29 and the intake opening 34 of the engine 14 are set at approximately same height and the engine side intake portion 27C extends in the front-rear direction under an approximately horizontal posture.

The intake branching portion 31 divides air which has been cleaned through its passage in the air cleaner 28 and its intake amount has been adjusted by the throttle valve 30 into two lines and feeds it to combustion chambers of the respective cylinders of the engine 14.

The blowby gas returning passage 32 is connected to a portion which is on more downstream side in the flow direction than the air cleaner 28 and which also is on more upstream side in the flow direction than the inclined passage portion 36 of the intermediate intake portion 27B of the intake pipe 27. And, the portion in the intermediate intake portion 27B of the intake pipe 27 to which portion the blowby gas returning passage 32 is connected is supported to the engine 14 via a bracket 38. Namely, as shown in FIG. 4, at a rear side portion of the engine 14, a supporting member 39 is fixed and this supporting member 39 extends to the rear side. At a rear upper side portion of this supporting member 39, the bracket 38 is connected and an upper portion of the bracket 38 is connected to a flange portion 40 provided in the intermediate intake portion 27B of the intake pipe 27.

Blowby gas which has leaked through gaps between the pistons and the cylinders of the engine 14 is returned via the blowby gas returning passage 32 into the intake passage 26, and through this intake passage 26, it is fed again to the engine 14 to be combusted inside the combustion chambers.

As shown in FIG. 3 and FIG. 4, since the inclined passage portion 36 is provided at a portion on downstream side in the flow direction of a returning passage connecting portion Q of the intake passage 26 to which portion the blowby gas returning passage 32 is connected, water contained in the blowby gas will be guided to flow down through the inclined passage portion 36 and then drained through the water draining portion 37 located at the lowermost end. Further, since the returning passage connecting portion Q and the throttle valve 30 are spaced apart from each other, the possibility of water contained in the blowby gas entering the throttle valve 30 is lessened.

Modified Embodiments of First Embodiment (1-1) In the foregoing first embodiment, there was disclosed the arrangement in which the resonator 29 is connected to the lowermost end of the inclined passage portion 36. In place of this arrangement, the resonator 29 may be provided on the upstream side of the inclined passage portion 36 or on more upstream side than the air cleaner 28. Further alternatively, such resonator 29 can be omitted at all.

(1-2) In the foregoing first embodiment, there was disclosed the arrangement in which the longitudinal direction of the air cleaner 28 is aligned with the vehicle body lateral direction. In place of this arrangement, the longitudinal direction of the air cleaner 28 may be aligned with the vehicle body front-rear direction.

(1-3) In the foregoing first embodiment, there was disclosed the arrangement in which the ambient air inlet opening 33 of the intake pipe 27 is disposed in the space formed inside the front lid 6. In place of this arrangement, for instance, the ambient air inlet opening 33 of the intake pipe 27 may be located at a portion such as a rear portion of the driver's seat 9 of the driving section 3 where air with relatively less mixed dust is present.

(1-4) In the foregoing first embodiment, there was disclosed the arrangement in which a gasoline engine is provided as the engine 14. In place of this arrangement, a diesel engine may be provided or an engine and a traveling electric motor may be provided or only an electric motor may be provided.

(1-5) In the foregoing first embodiment, there was disclosed the arrangement in which the belt type stepless speed changer mechanism 15 is provided. In place of this arrangement, a hydrostatic speed changer mechanism may be provided instead of the belt type stepless speed changer mechanism 15.

(1-6) In the foregoing first embodiment, there was disclosed the arrangement in which two persons can ride in the driving section. Alternatively, it is possible to arrange such that three or more persons can ride.

Second Embodiment

Next, a second embodiment as one of embodiments relating to an inventive work vehicle will be explained with reference to the accompanying drawings.

General Configuration of Utility Vehicle According to Second Embodiment

Figure 5:
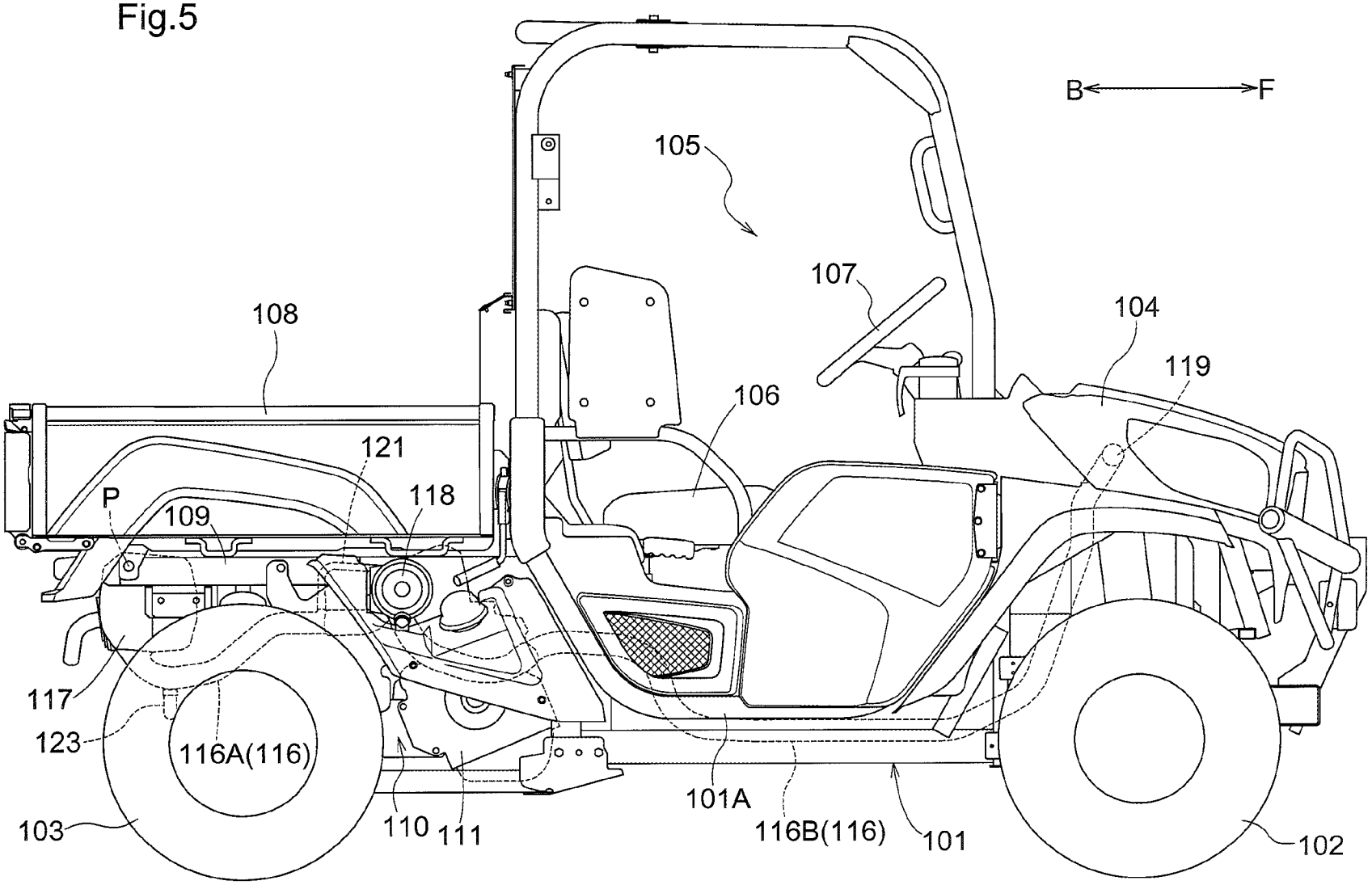
FIG. 5 is a right side view showing an entire utility vehicle according to a second embodiment.

As shown in FIG. 5, the utility vehicle includes a vehicle body 101 having a vehicle body frame 101A constituted of an assembly of pipe frame members, etc., a pair of left and right front wheels 102 attached to a front portion of the vehicle body 101 to be drivable and steerable, and a pair of rear wheels 103 attached to a rear portion of the vehicle body 101 to be drivable. At a front portion of the vehicle body 101, there is provided a front lid 104 which covers the upper side such as the front portion of the vehicle body frame 101A, etc. Between the front wheels 102 and the rear wheels 103, there is formed a driving section 105. In this driving section 105, there are provided a driver's seat 106, and a steering wheel 107 for steering the front wheels 102. A a rear portion of the vehicle body 101, there is provided a load carrying deck 108. This load carrying deck 108 is supported to the vehicle body frame 101A to be pivotally switchable about an axis P extending in the vehicle body width direction of a support shaft mounted to a rear portion of the load carrying deck 108, between an elevated discharging posture in which a front end portion of the deck is elevated relative to the vehicle body 101 and a lowered loading posture in which the front end portion of the deck is lowered relative to the vehicle body 101. In the rear portion of the vehicle body 101 and at a portion under the load carrying deck 108, there is provided an engine section 110 having an engine 111 for outputting power to the front wheels 102 and the rear wheels 103.

[Arrangement of Engine Section 110]

Figure 6:
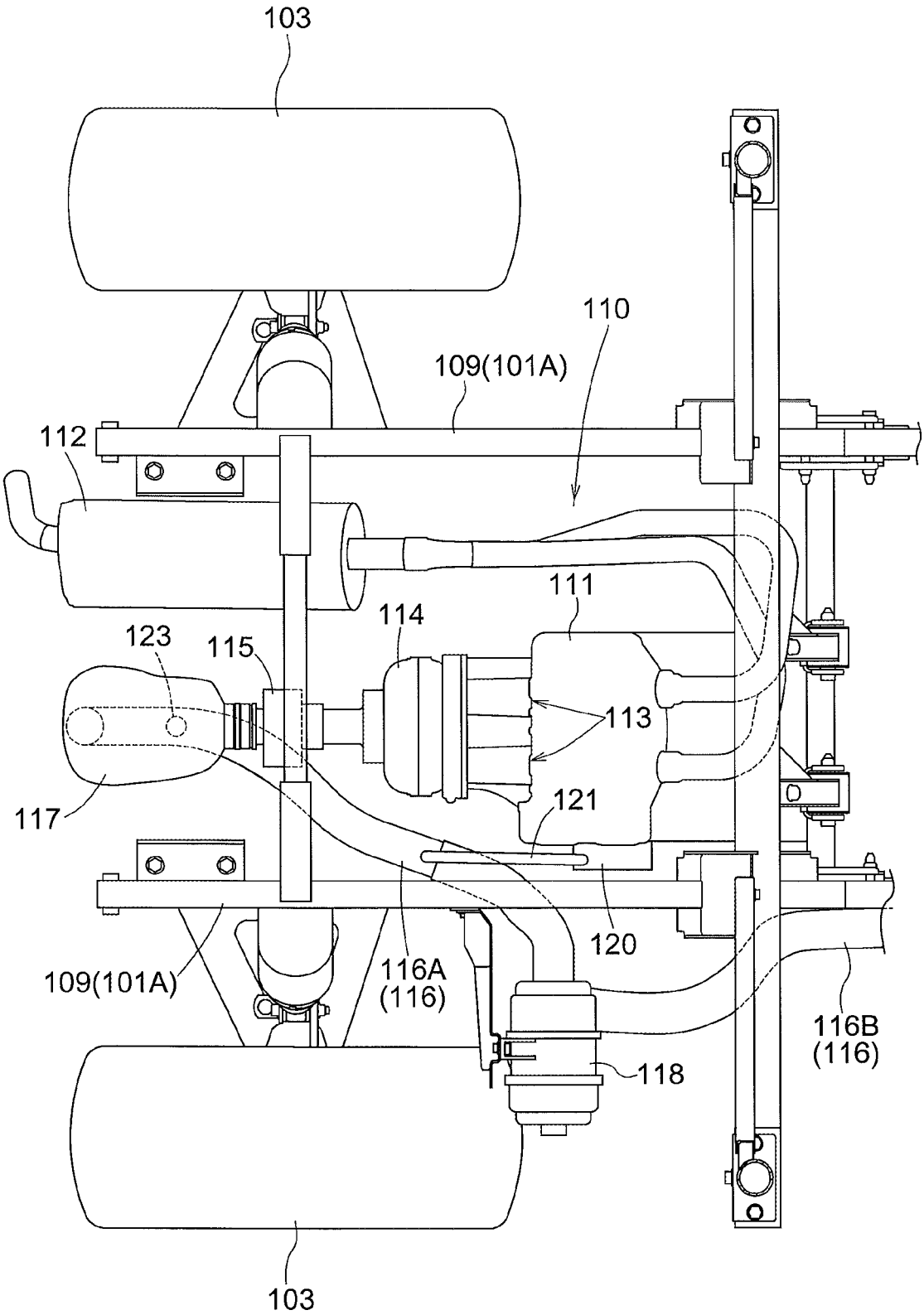
FIG. 6 is a plan view showing an engine section in the second embodiment.

The engine section 110, as shown in FIG. 6, includes the engine 111, an engine exhaust muffler 112, etc. The engine 111 is disposed between a pair of left and right rear frames 109 mounted to a rear portion of the vehicle body frame 101A to extend in the vehicle body front-rear direction and is supported to the rear frames 109. The exhaust muffler 112 is disposed between the left and right rear frames 109 and at a portion on more left lateral side than the engine 111.

Figure 7:
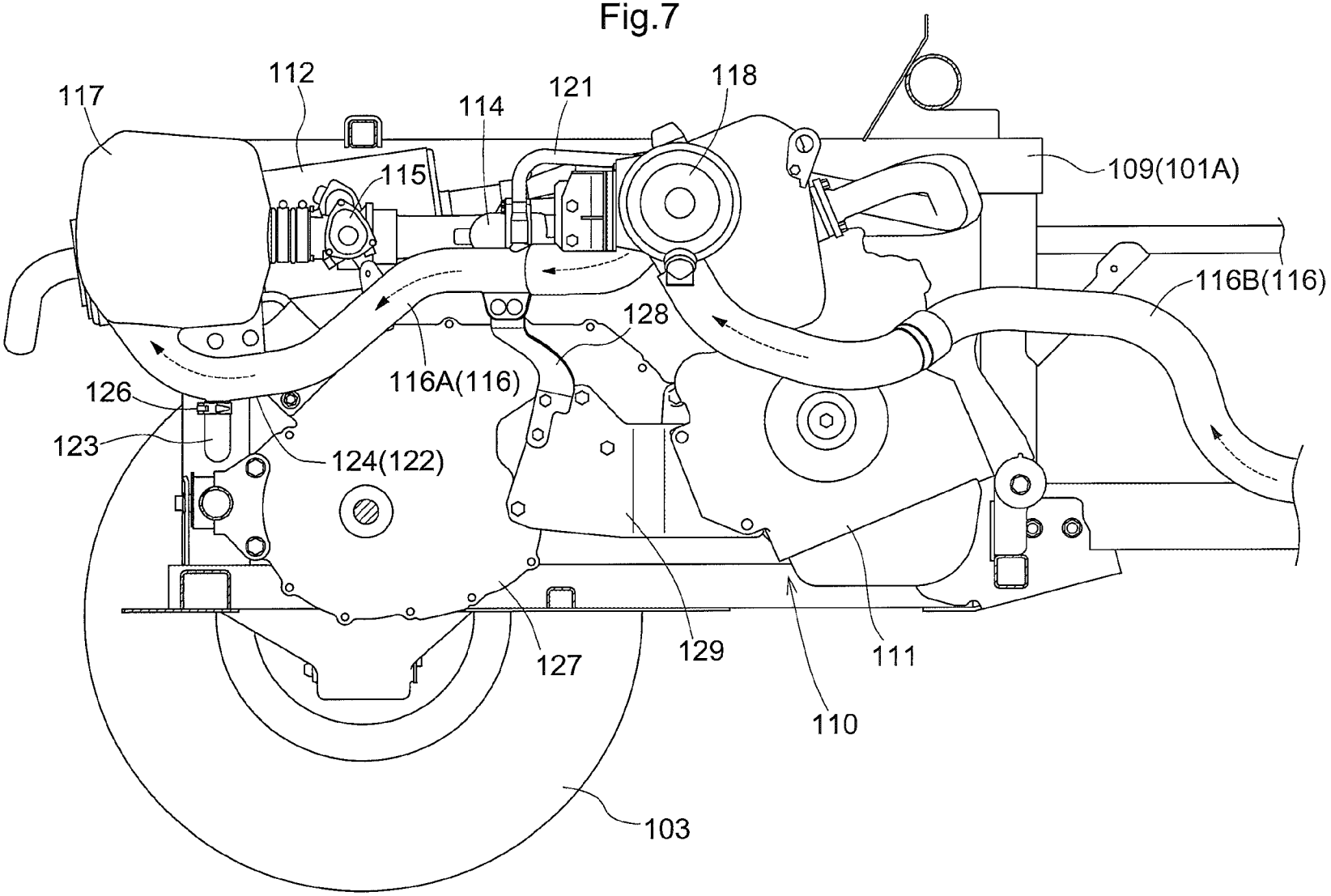
FIG. 7 is a side view showing an impurity collecting portion in the second embodiment.

As shown in FIG. 6, at a rear portion of the engine 111, there are formed intake openings 113 for introducing combustion air. To these intake openings 113, there is connected an intake passage 116 via a combustion chamber 114 and a throttle valve 115. The intake passage 116, as shown in FIGS. 6 and 7, includes a resonator 117 connected to the throttle valve 115, an air cleaner 118 provided at a portion located on the vehicle body right side in the outer circumference of the vehicle body 101, a downstream intake pipe passage 116A that connects an intake portion of the resonator 117 and an outlet portion of the air cleaner 118, and an upstream intake pipe passage 116B that extends in the vehicle body front direction from the intake portion of the air cleaner 118. The upstream intake pipe passage 116B, as shown in FIG. 5, extends to the inner side of the front lid 104. An ambient air inlet opening 119 at the leading end of the upstream intake pipe passage 116B is opened into the inner space of the front lid 104. A reference numeral 127 shown in FIG. 7 denotes a traveling transmission for transmitting power of the engine 111 to the rear wheels 103 and the front wheels 102. A reference numeral 128 shown in FIG. 7 denotes a stay for supporting the downstream intake pipe passage 116A. The stay 128 is supported to a support member 129. This support member 129 extends rearwards from the engine 111 and supports the traveling transmission 127 on its extension end side.

In the intake passage 116, due to a suction force generated from the engine 111, air present in the inner space of the front lid 104 is sucked via the ambient air inlet 119 into the upstream intake pipe passage 116B and introduced by this upstream intake pipe passage 116B into the air cleaner 118. Air after its dust removal treatment by the air cleaner 118 is introduced via the downstream intake pipe passage 116A into the resonator 117. And, this air, while being subjected to silencing treatment of its intake noise, is sucked as combustion air into the engine 111 via the throttle valve 115 and the combustion chamber 114.

As shown in FIG. 6, at a lateral portion of the engine 111, there is formed a blowby gas discharging portion 120. A blowby gas returning passage 121 is connected to a PCV (Positive Crankcase Ventilation) valve (not shown) as a flow rate adjusting valve for blowby gas incorporated in the blowby gas discharging portion 120 and to the downstream intake pipe passage 116A of the intake passage 116. In operation, blowby gas discharged from the engine 111 is returned via the blowby gas returning passage 121 to the downstream intake pipe passage 116A and returned from this downstream intake pipe passage 116A via the resonator 117 and the throttle valve 115 to the combustion chamber 114 to be re-combusted in this combustion chamber 114.

Figure 8:
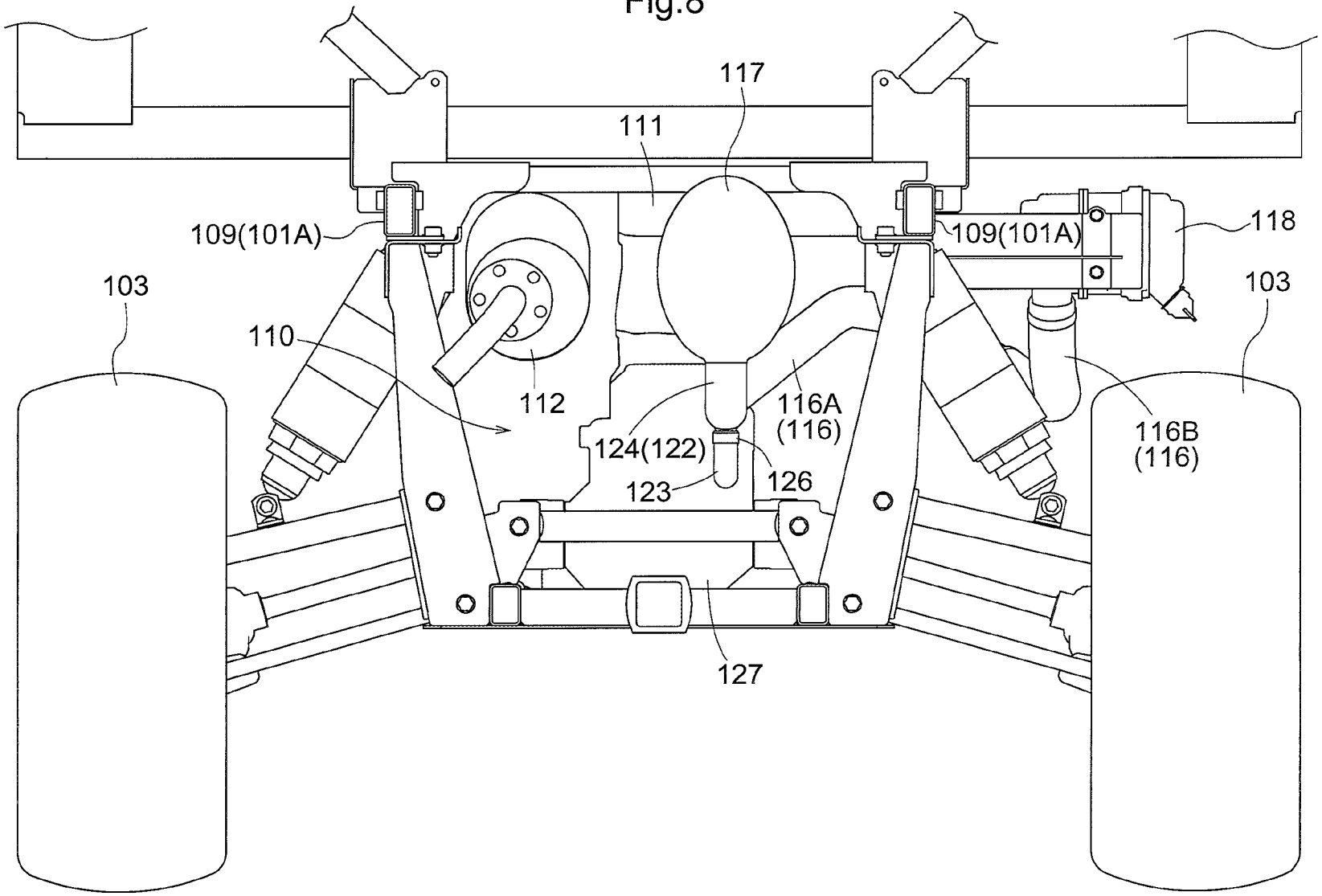
FIG. 8 is a rear view showing the impurity collecting portion in the second embodiment.

As shown in FIG. 7 and FIG. 8, in the downstream intake pipe passage 116A, at a portion thereof more downstream than its portion connected to the blowby gas returning passage 121, there is provided an impurity collecting portion 124 having a drain container 123. In operation, oil and water as impurities contained in the blowby gas are collected by the impurity collecting portion 124 and collected oil and water are stored in the drain container 123.

Figure 9:
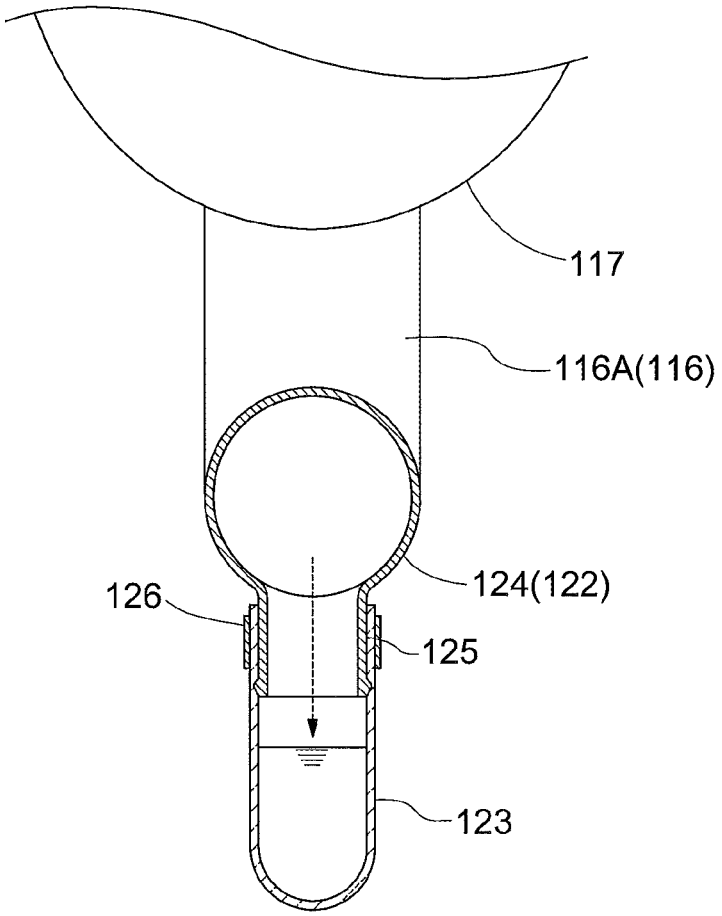
FIG. 9 is a section view showing a drain container in the second embodiment.

More particularly, the downstream intake pipe passage 116A includes a curved pipe passage portion 122 which is curved downwards. The impurity collecting portion 124 is constituted of this curved pipe passage portion 122. As shown in FIG. 9, at the bottom of the curved pipe passage portion 122, a discharging tubular portion 125 is formed.

And, the drain container 123 is fitted to this discharging tubular portion 125. When blowby gas and oil and water contained in this blowby gas are introduced in the curved pipe passage portion 122, since this curved passage portion 122 is curved downwards, the oil and water will be accumulated at the bottom of the curved pipe passage portion 122, whereby the blowby gas will be separated from the oil and water and then pass through the curved pipe passage portion 122. With this, the oil and water contained in the blowby gas will be collected in the impurity collecting portion 124. And, the collected oil and water will be discharged via the discharging tubular portion 125 into the drain container 123.

The impurity collecting portion 124, as shown in FIGS. 6, 7 and 8, is provided at the outer circumferential portion in the rear portion of the vehicle body 101 as the outer circumferential portion of this vehicle body 101. The drain container 123 is detachably provided in the impurity collecting portion 124. More specifically, as shown in FIG. 9, the receiving opening of the drain container 123 is fitted to the discharging tubular portion 125 from the lower side thereof and the receiving opening is placed in pressed contact with the discharging tubular portion 125 by means of a fastening band 126. The drain container 123 is configured to allow transparent viewing of the stored impurities from the outside of this drain container 123. Specifically, the entire drain container 123 is formed of a transparent material. However, the arrangement is not limited to the entire drain container 123 being formed of transparent material, but a slit-like window can be formed therein instead.

By viewing the drain container 123 from the rear side of the vehicle body 101, and based on storage of impurities, if any, in the drain container 123, it is possible to determine whether collection of impurities is or has been effected or not. Further, it is also possible to determine whether removal of stored impurities is necessary or not. If it is determined that repair or removal is needed, then, the repair is readily possible as the impurity collecting portion 124 can be readily accessed by a hand introduced from the rear side of the vehicle body 101. Further, impurities collected by detachment of the drain container 123 can be taken out of this drain container 123.

Modified Embodiments of Second Embodiment (2-1) In the foregoing second embodiment, there was disclosed the arrangement in which the impurity collecting portion 124 is provided at the outer circumferential portion in the rear portion of the vehicle body 101. The invention is not limited thereto. For instance, the impurity collecting portion 124 can be provided at any other portion of the outer circumference such as at the outer circumference on a lateral side portion of the vehicle body 101.

(2-2) In the foregoing second embodiment, there was disclosed the arrangement in which the impurity collecting portion 124 constituted of the intake passage 116 is employed. The invention is not limited thereto. For instance, it is also possible to employ a specially provided impurity collecting portion such as an impurity collecting portion configured to separate impurity from blowby gas by causing impurity-containing blowby gas to collide a collision member.

(2-3) In the foregoing second embodiment, there was disclosed the arrangement in which the drain container 123 that allows transparent viewing of stored impurity from the outside is employed. The invention is not limited thereto. For instance it is also possible to employ a drain container that does not allow such transparent viewing.

The invention claimed is:

1. A work vehicle comprising:

an engine;

an intake passage through which combustion air flows from an ambient air inlet to the engine;

an air cleaner for removing dust contained in the combustion air;

a throttle valve for adjusting an intake amount of the combustion air by the engine;

a blowby gas returning passage for returning blowby gas discharged from the engine to a mid portion of the intake passage; and an inclined passage portion that assumes a progressively downwardly inclined posture to be located at a lower position on downstream side in a flow direction, the inclined passage portion having a water draining portion at its lowermost end, the inclined passage portion being provided at a flow direction downstream portion at a returning passage connecting portion of the intake passage to which the blowby gas returning passage is connected;

wherein the blowby gas returning passage is connected to the intake passage on a more downstream side in the flow direction than the air cleaner; and wherein the throttle valve is provided at a position that is on a downstream side in flow direction of the inclined passage portion and that is at a height that is approximately equal to or greater than a height of the returning passage connecting portion.

2. The work vehicle of claim 1, wherein a resonator is provided on more downstream side in the flow direction than the lowermost end of the inclined passage portion.

3. A work vehicle comprising: an engine supported to a vehicle body; a blowby gas returning passage for returning blowby gas discharged from the engine to an intake passage of the engine; and an impurity collecting portion provided in an outer circumferential portion of the vehicle body for collecting impurity contained in the blowby gas, wherein the impurity collecting portion comprises a curved pipe passage portion of the intake passage, the curved pipe passage portion being downwardly curved, and wherein the impurity collecting portion detachably includes a drain container in which collected impurity is stored.

4. The work vehicle of claim 3, wherein the drain container is configured to allow transparent viewing of the impurity stored therein from the outside of the drain container.

5. The work vehicle of claim 3, further comprising:

a load carrying deck supported to a rear portion of the vehicle body, the load carrying deck being vertically pivotable between an elevated discharging posture wherein a front end portion of the deck is elevated relative to the vehicle body and a lowered loading posture wherein the front end portion of the deck is lowered relative to the vehicle body;

wherein the impurity collecting portion is provided in an outer circumferential portion of a rear portion of the vehicle body as the outer circumferential portion.

6. A work vehicle comprising: an engine supported to a vehicle body; a blowby gas returning passage for returning blowby gas discharged from the engine to an intake passage of the engine; and an impurity collecting portion for collecting impurity contained in the blowby gas; wherein the impurity collecting portion is provided on a more downstream side of the intake pipe passage in the flow direction than a returning passage connecting portion of the intake passage to which the blowby gas returning passage is connected, and wherein the impurity collecting portion detachably includes a drain container in which collected impurity is stored.

* * * * *